US005482565A

United States Patent [19]

Gutterman et al.

[11] Patent Number: 5,482,565

[45] Date of Patent: Jan. 9, 1996

[54] METHOD FOR WASHING BALLS

[75] Inventors: Bernard Gutterman, Greensboro, N.C.; Duane Acker, Mundelein, Ill.; Richard J. Walter, Arlington Heights, Ill.; Joe L. Solling, Libertyville, Ill.

[73] Assignee: Discovery Zone, Inc., Chicago, Ill.

[21] Appl. No.: 316,700

[22] Filed: Sep. 30, 1994

Related U.S. Application Data

[62] Division of Ser. No. 827,773, Jan. 29, 1992, Pat. No. 5,353,822.

[51] Int. Cl.[6] ..... B08B 1/04

[52] U.S. Cl. ..... 134/25.4; 134/25.5; 134/32; 134/34

[58] Field of Search ..... 134/34, 25.4, 25.5, 134/32, 42, 65, 1, 10, 6, 23

[56] References Cited

U.S. PATENT DOCUMENTS

| | | | |
|---|---|---|---|
| 703,916 | 7/1902 | Haley . | |
| 790,834 | 5/1905 | Harvey . | |
| 937,970 | 10/1909 | Taplin . | |
| 2,005,115 | 6/1935 | Stutz . | |
| 2,089,102 | 8/1937 | Savage . | |
| 2,690,576 | 10/1954 | Dreesman . | |
| 3,382,046 | 5/1968 | Faugeras et al. . | |
| 3,412,573 | 11/1968 | Pauliukonis . | |
| 3,722,401 | 3/1973 | Davidson et al. . | |
| 4,073,301 | 2/1978 | Mackinnon . | |
| 4,098,225 | 7/1978 | Norman . | |
| 4,106,705 | 8/1978 | Nakamura . | |
| 4,168,715 | 9/1979 | Bahrke . | |
| 4,258,069 | 3/1981 | Amstad . | |
| 4,448,118 | 5/1984 | Kunz . | |
| 4,773,114 | 9/1988 | Thrasher . | |
| 4,782,843 | 11/1988 | Lapaglia . | |
| 4,970,746 | 11/1990 | Brackmann . | |
| 4,987,702 | 1/1991 | Anschutz . | |
| 5,020,555 | 6/1991 | Nishibayashi | 134/65 |
| 5,139,577 | 8/1992 | Brock . | |

FOREIGN PATENT DOCUMENTS

| | | |
|---|---|---|
| 0264462 | 4/1988 | European Pat. Off. . |
| 220504 | 4/1910 | Germany . |
| 43735 | 5/1964 | Japan . |
| 391824 | 7/1973 | U.S.S.R. . |

*Primary Examiner*—Jan H. Silbaugh
*Assistant Examiner*—Robin S. Gray
*Attorney, Agent, or Firm*—Pennie & Edmonds

[57] ABSTRACT

An apparatus and method for washing balls in a fluid is disclosed which includes a container for storing soiled balls and a wash unit having an elongated cylindrical housing suitable for containing the fluid and having a lower end adapted for receiving balls and an upper end adapted for discharging balls. The container serially dispenses balls via a transfer chute to the lower end of the housing. The transfer chute includes apparatus for separating regular and irregular balls. Inside the housing, balls are conveyed from the lower end to the upper end by a screw conveyor system which agitates and scrubs the balls. The screw conveyer system includes an first screw conveyor located near the lower end, and a second screw conveyor located near the upper end. The first and second screw conveyors are spaced to form a conveyor free wash cell. Balls are discharged at the housing's upper end to a ramp having a plurality of overlapping flights, where the balls are rinsed.

6 Claims, 5 Drawing Sheets

METHOD FOR WASHING BALLS

This is a division of application Ser. No. 07/827,773 filed Jan. 29, 1992, now U.S. Pat. No. 5,353,822.

FIELD OF THE INVENTION

The present invention relates to devices for washing balls. More particularly, the invention relates to devices for washing soft plastic balls commonly used for recreational purposes.

BACKGROUND OF THE INVENTION

Balls used for recreational purposes typically become soiled. For example, in the field of children's playground equipment, pits are filled with a large number of soft plastic multicolored balls, each approximately 3 inches in diameter. Children and adults then roll and frolic in the ball-filled pits, thereby soiling the balls. For health and sanitation reasons, the balls are periodically cleaned. This need for sanitation is particularly acute because balls in the ball pit are placed into direct contact with the faces and mouths of adults and children playing therein. Because of this contact, it is also important that any chemicals that are used to clean the balls are thoroughly rinsed off.

A number of devices are known which automatically or semiautomatically clean balls. One such device has a cylindrical housing in which an elongated screw conveyor is rotatably disposed. The conveyor carries balls from a ball inlet to a ball outlet, the ball inlet and outlet being located at opposite longitudinal ends of the housing.

While these devices are suitable, there exists a need for a ball washer which more thoroughly cleans and rinses balls. Such a device may operate near children playing in ball pits, and therefore should also have an operation which provides visual appeal and stimulation to children. Another consideration is that balls used in ball pits are often crushed because they are soft plastic. Ideally, a ball washing device should also separate crushed, defective or otherwise irregular balls from normal balls.

Finally, because of the large number of balls which may require washing, it is desirable to provide a bulk container for storing both dirty and clean balls. The apparatus should be semiautomatic so that a human operator is not required to continuously feed balls into the apparatus.

SUMMARY OF THE INVENTION

It is therefore an object of the invention to provide an apparatus for washing balls which has an improved cleaning and rinsing action and which provides visually interesting operation.

It is another object of the invention to provide an apparatus for washing balls which separates regular and irregular balls.

It is yet another object of the invention to provide an apparatus for washing large numbers of balls stored in a bulk supply and storing the washed balls in a bulk storage bin without requiring a human operator to continuously feed the apparatus.

In accordance, with these objects, a new apparatus for washing balls in a fluid is disclosed. In a preferred embodiment, the apparatus includes a washing unit having a vertical elongated cylindrical housing which is suitable for containing the fluid. The housing may be made of transparent plastic so that children may see the ball washer's internal operations. Balls enter the housing through an inlet opening in one and preferably its lower end, and are conveyed upward by a novel screw conveyor system and into a conveyor-free volume or wash cell and towards the housing's other and preferably upper end, where they are discharged through an outlet opening. In conveying the balls on the conveyor and through the wash cell the balls are washed.

The novel screw conveyor system includes a first screw conveyor located near the housing's lower end, and a second screw conveyor located near the housing's upper end. The first and second screw conveyors are spaced apart from each other to define a conveyor free volume or wash cell preferably generally near the middle portion of the housing's longitudinal extent. Thus, the first screw conveyor conveys balls from the input opening into the wash cell. Balls so conveyed accumulate in the wash cell, where they move, spin and contact each other in a generally random fashion, usually in a more random fashion than when on the screw conveyor. As first screw conveyor drives more balls into the wash cell, the balls therein are agitated and scrubbed and continue movement towards the outlet opening.

The second screw conveyor conveys balls from the top of the wash cell to the ball discharge opening. Because the wash cell can hold more balls than a comparable length of screw conveyor and has a volume preferably roughly equal to four flights of the screw conveyor, balls have a substantial residence time in the wash cell before being removed by the second screw conveyer. This residence of time allows for additional cleaning, scrubbing and agitation of balls contained in the wash cell.

In one embodiment, a third screw conveyor having one or two flights is placed in the housing between the first and second screw conveyors to subdivide the wash cell into first and second portions.

In another embodiment, a recirculation system continuously drizzles or sprays cleaning fluid from a nozzle or nozzles located near the top of the housing. The fluid wets the balls contained in the housing and drips down to a drain located near the bottom of the housing, from where the fluid is withdrawn for discharge or subsequent recirculation.

In another embodiment, the first and second screw conveyors are first and second sets, respectively, of screw conveyor flights mounted in spaced relation on a common elongated rotatable shaft. The shaft is preferably coaxially mounted inside the housing. The conveyor free space or wash cell is the extent along the shaft where no flights are mounted. The first and second screw conveyor flights could also operate independently of one another (for example, each conveyor flight could be mounted on a separate shaft driven by a separate drive mechanism).

In yet another embodiment, the apparatus includes a container for storing soiled balls. The container is equipped with a ball output located near the bottom of the container for sequentially outputting balls at a predetermined rate. In some cases, the container is also equipped with a shield for protecting balls being discharged from the weight of the balls accumulated in the container. The intervals at which balls are discharged may be periodically varied in accordance with a predetermined pattern.

In yet another embodiment, washed balls are discharged from the upper end of the housing to a ramp. The balls roll down the ramp to a discharge point. The ramp can be formed from an elongated member having two sidewalls which are connected along longitudinal edges to form a channel or track having a V-shaped cross section. The upwardly extending edges of the sidewalls form a track along which balls may roll.

The ramp is arranged in overlapping flights so that lower sections pass underneath upper sections. For example, the ramp may be spiraled or may comprise a plurality of ramps arranged in a zig-zag pattern of alternating downwardly extending flights. A rinse fluid (preferably water) outlet is provided near the top of the ramp, and a drain intake is provided near the bottom.

Rinse fluid outlet sprays a rinse fluid (preferably water) on balls as they roll by. The rinse fluid runs down along the channel defined by the ramp's sidewalls. Holes along the bottom of the channel to allow the rinse fluid to drain out of each ramp flight and rain onto the flight immediately below. In this manner, rinse fluid is repeatedly sprayed or drizzled on the balls as they roll down the track, even if only one initial rinse fluid outlet is provided.

In an alternative embodiment, separate rinse outlets and drains are provided for each of the top several overlapping ramp flights. Thus, in this embodiment, rinse fluid does not drain from flight to flight as in the previously-described embodiment. Rather, rinse fluid is collected by a drain from each flight, and may be discharged as waste or, if sufficiently clean, recycled.

In yet another embodiment, a first pneumatic conveyor conveys balls from the ball pit or other storage bin to a soiled ball container. The soiled ball container serially outputs balls to a downwardly extending transfer chute terminating at the lower ball receiving end of the washing unit. The transfer chute has spaced parallel rails forming a track over which balls of standard diameter may roll. Balls which are not of standard diameter or otherwise irregular fall through he space between the rails and do not reach the washing unit.

In yet another embodiment, a second pneumatic conveyor conveys balls from the end of the ramp to a storage bin where the clean balls are stored in bulk.

DETAILED DESCRIPTION OF THE PREFERRED EMBODIMENTS

Figure 1:
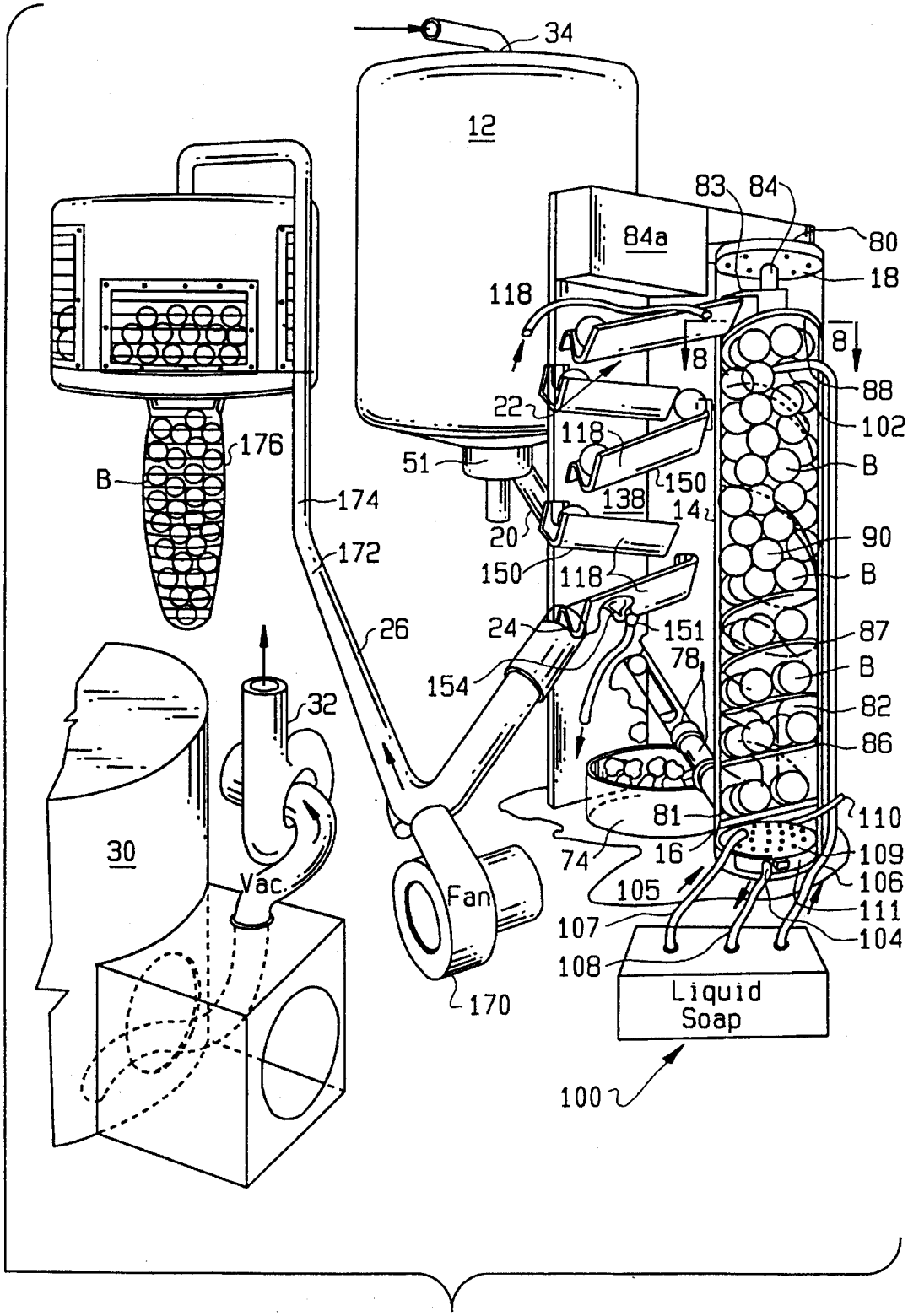
FIG. 1 is a perspective view of an apparatus for washing balls in accordance with the invention.

FIG. 1 illustrates an apparatus 10 for washing balls such as balls B in a fluid, such as a cleaning fluid. Apparatus 10 includes a container 12 for storing soiled balls and an elongated wash unit 14 having a first end 16 adopted for receiving balls B and a second end 18 adopted for discharging balls B. A transfer chute 20 transfers balls from container 12 to first end 16 of wash unit 14, where balls B are received by wash unit 14 for washing. Once inside wash unit 14, the balls B are washed and then discharged from second end 18, as described below in greater detail.

After balls B are discharged through second end 18, they are conveyed by a discharge ramp 22 from second end 18 to a discharge point 24. The primary function of discharge ramp 22 is to rinse and partially dry balls B, as discussed below in greater detail. Balls B discharged from ramp 22 at discharge point 24 are conveyed by a first pneumatic conveyer 26 to a collection bin 28.

Ball washer 10 may be used to wash many types of ball-shaped objects. In one application, ball washer 10 cleans balls B of equal (or "standard" diameter) which are used for recreational purposes. In this capacity, balls B kept in a large open bin play area 30, where they provide a play media for adults and children (not shown). Over time, the occupation of bin 30 by people, particularly small children, causes the balls B therein to become soiled. For health and sanitation reasons, it is desirable to periodically wash balls B.

While the balls can be manually carried from bin 30 to container 12, another technique is to use a second pneumatic conveyor 32 to convey soiled balls from bin 30 to container 12. Alternatively, bin 30 may be used for simply storing soiled balls B, which are manually carried from yet another bin (not shown), which is used for recreational purposes.

Figure 2:
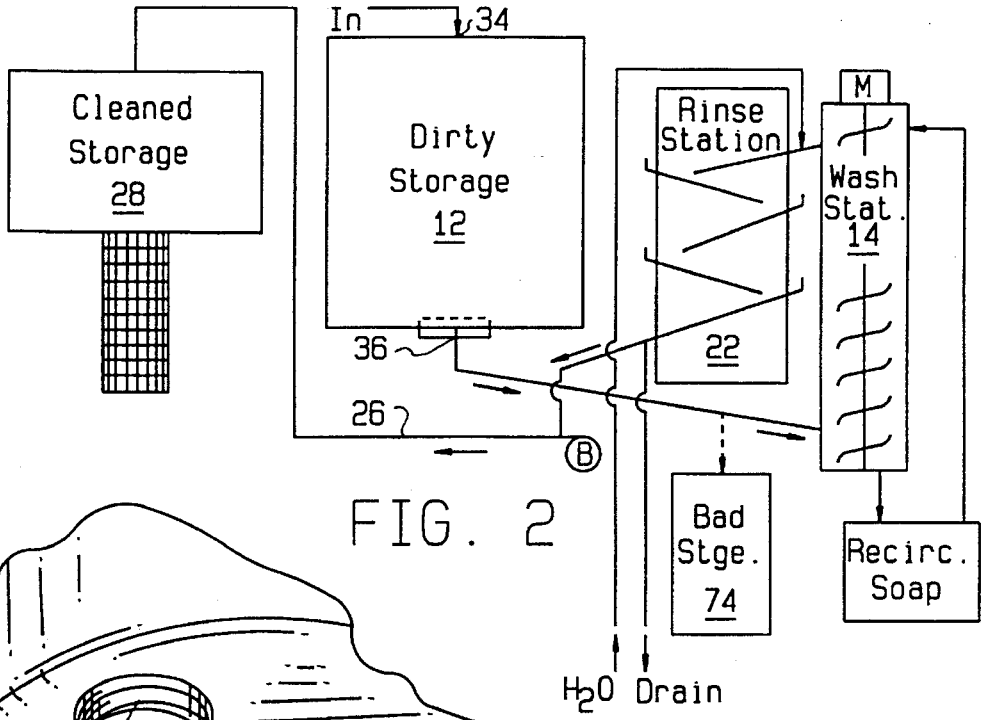
FIG. 2 is a block diagram of the apparatus for washing balls shown in FIG. 1.

Referring to FIG. 2, the functional interrelationships of the foregoing components are illustrated in a block diagram. As illustrated, a bulk supply of balls B enters soiled storage container 12 at an input port 34. Balls B are expelled serially from an output port 36. From output port 36, balls B are transferred via transfer chute 20 to the wash unit 14, and from wash unit 14 to discharge ramp 22 for rinsing. Finally, clean balls B are taken via first pneumatic conveyor 26 to collection bin 28 for storage.

The individual components of apparatus 10 are now discussed in detail. Referring to FIGS. I and 3, it will be seen that container 12 is generally closed and is of cylindrical shape. Input port 34 is located at the top end of container 12, and is operatively connected to second pneumatic conveyor 32 for receiving balls B therefrom. Output port 36 is located near the bottom end of container 12, and outputs balls serially into transfer chute 20 for delivery to wash unit 14. To avoid clogging of wash unit 14 and to otherwise improve performance, it is important that balls B be dispensed by output port 36 into the transfer chute 20 sequentially and at a measured rate such as approximately 5–15 balls per minute.

Figure 3:
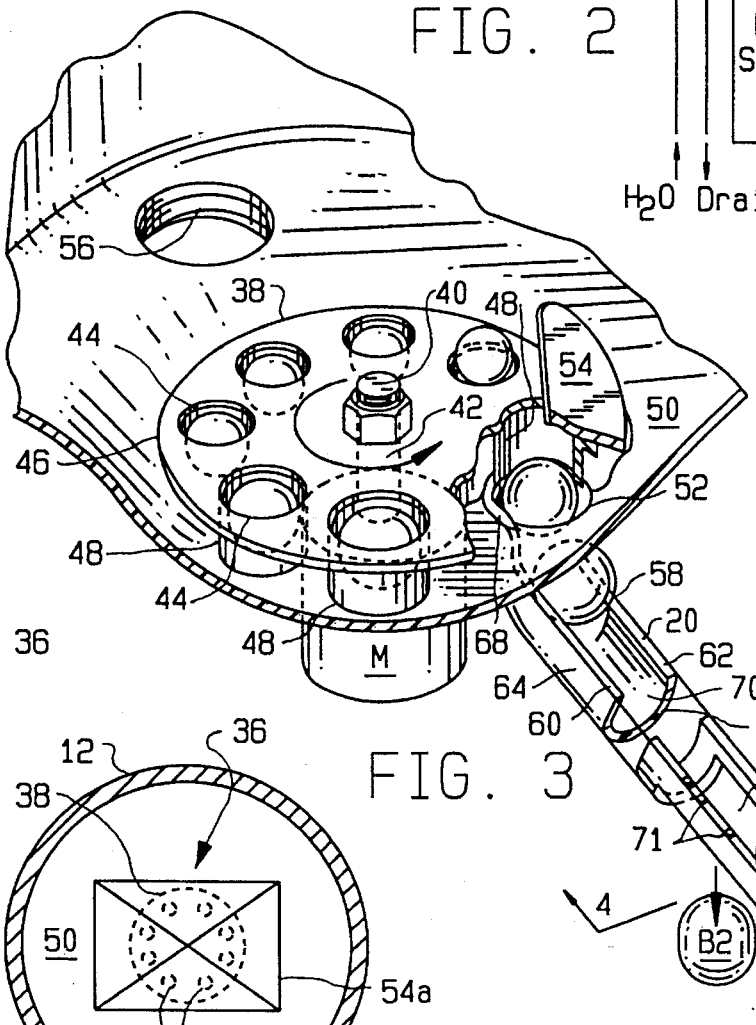
FIG. 3 is a cut-away view of the ball output of the container for storing soiled balls shown as part of the apparatus of FIG. 1.

Referring to FIG. 3, output port 36 is illustrated in greater detail. A disk 38 is mounted for rotation about its center point 40 by a vertically extending shaft 42 to a motor M. A plurality of holes or openings 44 are spaced at even intervals near the perimeter 46 of disk 38. Alternatively, a single hole may be used. For clarity, not every hole illustrated in FIG. 3 is designated by a reference numeral. Each hole 44 is larger in diameter than balls B and forms the upper lip of a downwardly extending open-ended cylindrical cup 48 which is sized to receive a single one of balls B. Shaft 42 holds disk 38 in spaced, parallel relation over a floor or bottom 50 of container 12 to allow cups 48 clearance thereover. Floor 50 has a recess 51 which receives disk 38 and cups 48.

As motor M rotates disk 38 in a counter-clockwise direction (as viewed from above), balls B contained in container 12 fall through holes 44, and become lodged in cups 48. As dish 38 rotates about center point 40, each of cups 48 sequentially traverses an outlet aperture 52 in floor 50 of container 12, through which a ball B contained in that cup 48 falls. A solid planar member 54 extends in spaced relation over at least a portion of disk 38 and in alignment with outlet aperture 52. Planar member 54 prevents additional balls B from falling through outlet aperture 52 via one of cups 48 when that particular cup 48 is located over outlet aperture 52.

As motor M continues to rotate, cups 48 pass over outlet aperture 52 and out from under board 54. As shown in FIG. 3, as empty cups 48 pass out from under planar member 54, new balls such as ball B1 drop into the cups. In this manner, balls B can be sequentially released from outlet aperture 52 of container 12. As will be apparent, the frequency at which balls B are released is a function of the rotational speed of disk 38 and the angular spacing of cups 44 about the perimeter of disk 38.

For greater visual appeal, holes 44 can be spaced at somewhat irregular intervals around perimeter 46 of disk 38. This allows balls to be expelled at the same average rate but at less regular intervals, thereby making the operation of output pox 36 appear to the casual observer to be random, and therefore, more interesting. The same effect can be achieved by varying the speed of variable speed motor M in accordance with a predetermined program.

Figure 3A:
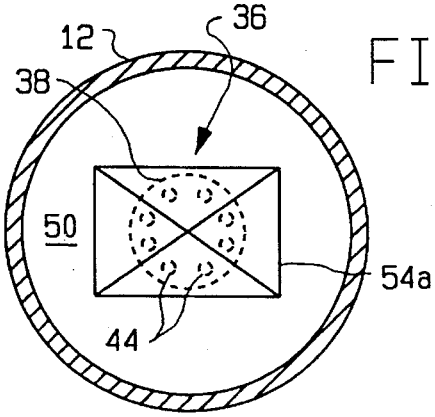
FIG. 3*a* is a top view of an alternative embodiment of the ball output of FIG. 3 showing a shield suspended above the ball output.

In some cases, depending upon the volume of container 12, the weight of balls B stored therein may be so great as to crush balls B entering output port 36. To alleviate this problem, a shield 54a may be used as shown in FIG. 3*a*. Shield 54a may be of any suitable shape such as a cone, or, as illustrated in FIG. 3*a*, a square pyramid. Shield 54*a* has a base that is somewhat wider than the diameter of disk 38. Preferably, the base of shield 54*a* is of a shape that is asymmetrical to the walls of container 12 to reduce bridging or Jamming of balls between the walls of container 12 and shield 54*a*.

Shield 54*a* is mounted to container 12 in any suitable manner so as to be suspended a short distance above disK 38. The suspension allows one or two layers of balls B to accumulated over disk 38.

Preferably, a cleanout or access aperture 56 is also provided in floor 50 of container 12. Normally, cleanout aperture 56 i blocked by a suitable hatch or the like (not shown). In special circumstances, such as when cleaning or repairing container 12, the hatch can be opened to allow quick discharge of the balls B stored in container 12 and access to the interior of container 12.

As balls B drop through outlet aperture 52, they fall onto transfer chute 20, which conveys balls B to the receiving end 16 of wash unit 14. Any suitable structure for conveying balls B to wash unit 14 can be utilized in accordance with the invention. As best seen in FIG. 3, transfer chute 20 includes a downwardly extending track 58 having two parallel rails 60 and 62 spaced by a distance slightly less than the standard or nominal diameter of balls B.

Rails 60 and 62 are defined by the longitudinal edges of an elongated member 64 having an arcuate, upwardly opening cross section 66 in the shape of the letter "C". Preferably, elongated member 64 curves upwardly at an end 68 adjacent outlet aperture 52 so that the rim defined by the longitudinal end 68 of member 64 is substantially horizontal and peripherally engages outlet aperture 52.

Figure 4:
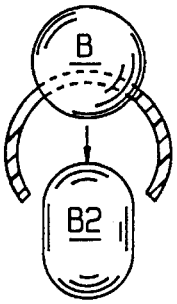
FIG. 4 is a sectional view of the soiled ball transfer chute taken along the lines 4—4 shown in FIG. 3.

Referring to FIGS. 3 and 4, it will be seen that the arcuate walls of elongated member 64 form a downwardly extending channel 70. A ball B placed on rails 60 and 62 is propelled by gravity over channel 70 toward wash unit 14. Because track 58 is narrower than the standard or nominal diameter of balls B, balls B cannot pass between rails 60 and 62 to enter channel 70. However, if a ball is irregularly shaped, it usually will have a dimension somewhat less than the diameter of a normal ball since the balls are hollow and have a relatively thin, flexible outer wall. For example, a damaged or defective ball such as ball B2 (shown in FIGS. 3 and 4) may be split open and flattened with respect to one axis, thereby allowing such a defective ball to pass between rails 60 and 62 when the ball is placed in a particular orientation.

Thus, deformed and damaged balls can fall through track 58 and slide dow channel 70. Occasionally, balls B are only slightly deformed, and will not fall through track 8 unless orientated on a particular axis of rotation. Bumps 1 along one of rails 60 and 62 (rail 60 in the embodiment illustrated in FIG. 3) cause balls B rolling thereover to change their respective axis of rotation, thereby increasing the probability that such balls will fall between rails 60 and 62. Alternatively track 58 may be curved to cause similar changes in the balls' axes of rotation.

A slot 72 is formed along the bottom of channel 70 along a portion of the longitudinal extent of member 64. Slot 72 is sufficiently wide to form an opening through which deformed balls such as deformed ball B2, may fall into any suitable container such as container 74 for storing deformed balls. (see FIGS. 1 and 2). A blocking member 76 spans the arcuate side of channel 70 for preventing deformed balls from sliding beyond the end of slot 72.

Near the bottom end of transfer chute 20 and past blocking member 76, track 58 widens to allow normal balls B to fall into channel 70. At a still further point downstream along transfer chute 20, rails 60 and 62 terminate at a collar 77, whereafter transfer chute forms an enclosed tube portion 78. The lower end of tube portion 78 is aligned with receiving end 16 of wash unit 14 to deposit balls therein. Tube portion 78 preferably enters wash unit 14 at an angle of between 45 and 90 degrees. Soiled balls in container 12 may be covered with lint from play area 30, particularly lint from clothing. A conventional rinse nozzle (not shown) may be provided along transfer chute 20 to rinse passing balls B prior to their entering into wash unit 14.

Figure 8:
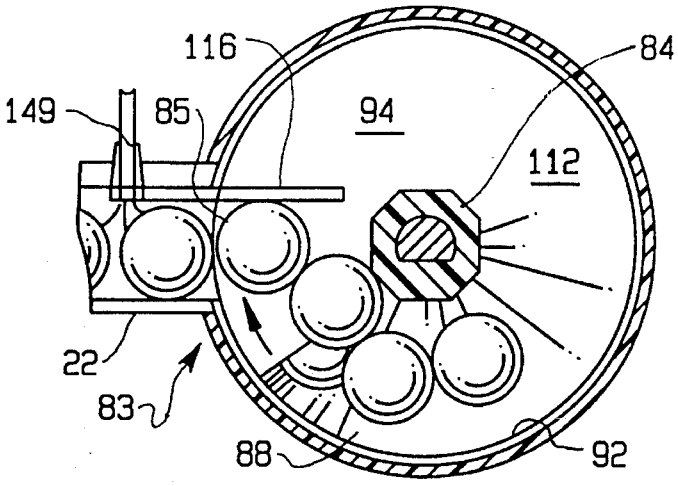
FIG. 8 is a top view of the housing shown as part of the apparatus of FIG. 1.

Referring to FIG. 1, wash unit 14 comprises a housing 80 forming an elongated chamber 82 which is preferably cylindrical in shape, and which is suitable for receiving a fluid. Housing 80 is preferably vertical (but may be inclined), with first receiving end 16 and second discharging end 18 being at lower and upper longitudinal ends, respectively, of housing 80. For convenience, a tightly resealable access door (not shown) may be provided in the wall of housing 80. During operation of wash unit 14, balls B are received through a ball inlet opening 81 at receiving end 16. The balls are then scrubbed and conveyed by a screw conveyor 87 upwardly to second end 18, where they are discharged through a ball output 83 which includes a ball output opening 85, as best seen in FIGS. 1 and 8.

Preferably, housing 80 is of transparent material, such as plexiglass allowing observers to see the internal operations of wash unit 14. As indicated above, the ball washer 10 may be used to clean balls used for children's recreation. It has been found that some children are intrigued by the internal operation of wash unit 14. By using transparent materials for housing 80, the internal operations of wash unit 14 are visually accessible to nearby children, thus providing those children with visual stimulation.

Screw conveyor 87 includes an elongated rotatable shaft 84 coaxially disposed in the housing 80. A motor 84*a* rotates shaft 84 clockwise (as viewed from above), at a suitable speed such as 16 revolutions per minute. A first and second set of flights 86 and 88 are conventionally mounted to shaft 84. The first and second set of flights 86 and 88 are spaced apart from each other and adjacent to opposite ends 16 and 18, respectively, of wash unit 14. A conveyor free volume or "wash cell" 90 resides in the volume along that portion of shaft 84 which separates first and second sets of flights 86 and 88. First set of screw flights 86 conveys balls from ball inlet opening 81 to wash cell 90, where balls accumulate. Second set of screw flights 88 conveys balls from wash cell 90 to ball output 3, where balls are discharged. The separation of first and second screw flights is important, as it allows for the existence of wash cell 90, wherein balls B are scrubbed against each other and the interior wall 92 of chamber 82.

In an alternative embodiment, a third set of one or more screw flights is mounted to shaft 84 between first and second sets of flights 86 and 88 to subdivide wash cell 90 into two or more separate wash cells. The third set of flights facilitates the churning and scrubbing action of balls B in wash cell 90.

Figure 5:
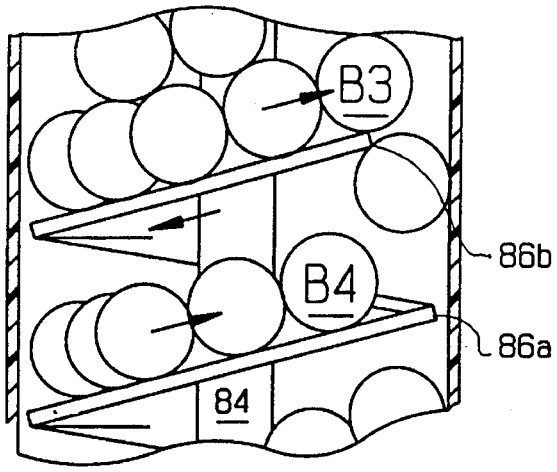
FIG. 5 is a partial sectional view of the housing shown as par of the apparatus of FIG. 1.

As best seen in FIGS. 5 and 8, first and second set screw flights 86 and 88 extend outwardly from shaft 84 to the interior wall 92. The vertical spacing of each individual flights, such as flights 86*a* and 86*b*, less then twice the diameter of an individual ball and greater than the nominal diameter of one of balls B. Moreover, the spiraling planar surface 94 defined by the flights is of a width less then twice the diameter of an individual ball. Planar surface 94 is inclined downwardly as it extends away from shaft 84 to urge balls B thereon against interior wall 92 of chamber 82.

Figure 6:
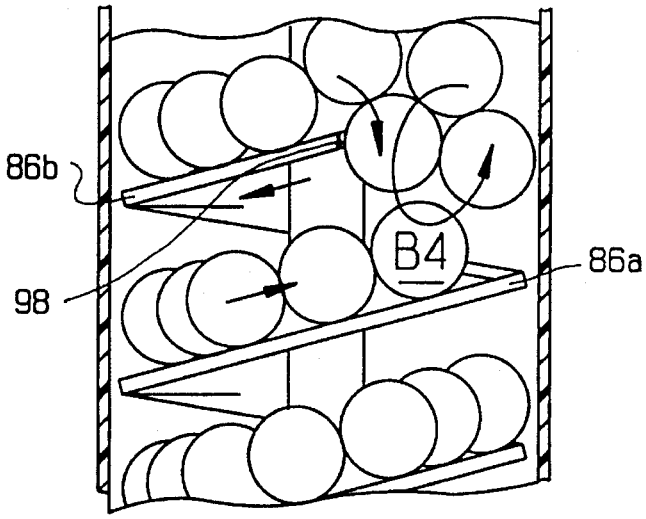
FIG. 6 is the partial sectional view of FIG. 5 taken at a later point in time than FIG. 5.
Figure 7:
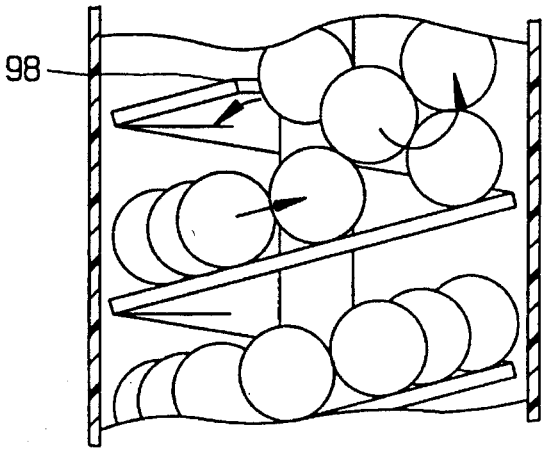
FIG. 7 is the partial sectional view of FIG. 5 taken at a later point in time than FIG. 6.

As shaft 84 rotates, balls B in chamber 82 are driven upwardly toward ball output 83. In particular, balls B are driven up first set of flights 86 toward wash cell 90. As best seen in FIGS. 1 through 7, balls B accumulating in wash cell 90 impinge on a topmost flight 86*b* of the first set of flights 86. As shaft 84 rotates, it rotates a trailing edge (or "terminus") 98 of topmost flight 96. As terminus 98 passes under balls B accumulating in wash cell 90, the balls such as ball B3 to drop to the flight 86*a* immediately below topmost flight 86*b*, as best seen in FIG. 6. This dropping motion rotates ball B3, and causes ball B3 to impinge against other balls such as ball B4 which are already on flight 86*a*.

While the exact motion of balls B is somewhat random, it will be observed that in the above-described operation of wash unit 14, a churning, agitation and scrubbing of balls B accumulating in wash cell 90 is achieved as the terminus 98 of flight 96 rotates with shaft 84. Specifically the impingement of rotating balls such as balls B3 and B4 against each other provides an especially effective scrubbing action.

As first set of flights 86 drives more balls B into wash cell 90, the accumulating balls B fill wash cell 90 until the uppermost of accumulating balls B reaches the second set of screw flights 88. It will be observed that balls passing into wash cell 90 remain there for a period of time until the agitating, churning and scrubbing action of first set of flights 86 works balls to the top of wash cell 90. The amount of time spent in wash cell 90 will vary from ball to ball, and the average residence time is a function of the speed of screw conveyor and the volume of wash cell 90. During this time, balls in wash cell 90 are scrubbed and cleaned, and thus effectively cleaned.

In order to thoroughly clean balls, a fluid such as a cleaning fluid may be provided. As best seen in FIGS. 1 and 2, a recirculation system 100 circulates cleaning fluid or solution (preferably a non-toxic, non-corrosive mixture of water and a suitable soap, detergent, surfactant or the like) through chamber 82. A fluid outlet 102 preferably located near second end 18 of wash unit 14 dispenses the fluid, while a fluid drain inlet 104 preferably located at the bottom of chamber 82 near first end 16 receives fluid. Fluid outlet 102 may have one or more stainless steel nozzles controlled by a regulating needle valve. For best results, at least two nozzles should be placed on diametrically opposing lateral sides of cylindrical housing 80.

An additional fluid outlet nozzle 105 may be included near first end 16 of wash unit 14. Additional outlet 105 ensures that balls B entering wash unit 14 are adequately wetted with cleaning fluid. It will be noted that adequate wetting provides lubrication which enables balls B to rub against each other and the walls of housing 80 in a cleansing, scrubbing motion. Alternatively, operation of screw conveyor 87 can be delayed for a suitable time period (such as twenty seconds) after fluid outlet 102 begins discharging fluid. By means of this delay, balls B resident in chamber 82 are sufficiently wetted prior to operation of screw conveyor 87.

A conventional pump (not shown) and lines 106, 107 and 108 circulate the fluid between fluid drain inlet 104 and fluid outlets 102 and 105. This recirculation operation is intended to conserve cleaning solution, and alternatively, used fluid may simply be discharged as waste. Fluid drain inlet 104 includes a floor piece 109 defining the bottom of chamber 82 and having a plurality of draining holes 110. Fluid draining through holes 110 is collected into line 108. A conventional, manually removable filter drawer 111 having an 80 or 100 mesh screen is placed between floor piece 109 and the terminus of line 108 to filter recirculated fluid.

Figure 9:
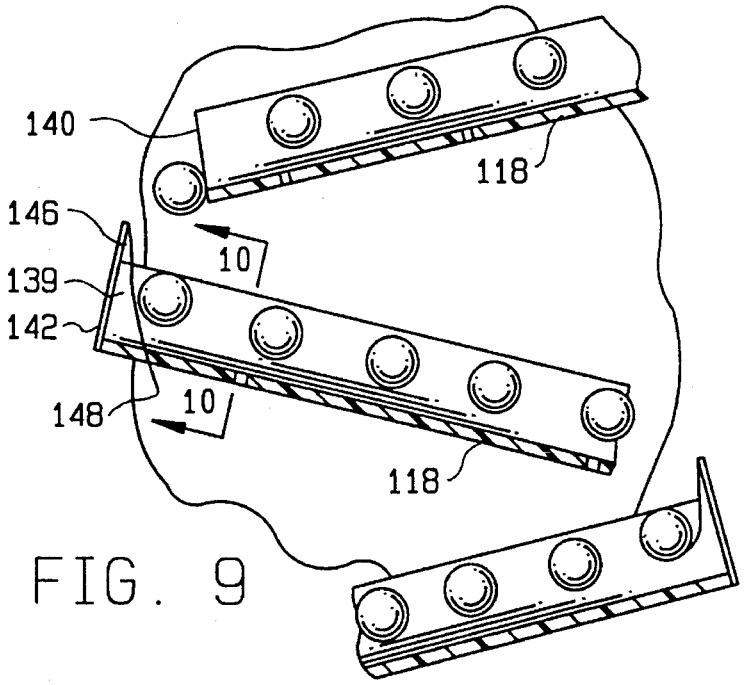
FIG. 9 is a side view of the discharge ramp shown as part of the apparatus of FIG. 1.

Balls B in wash cell 90 which impinge a second set of flights 88, are scooped up and conveyed toward ball output 83. As seen in FIG. 9, balls such as ball B6 residing on topmost flight 112 of second set of screw flights 88 are urged by inclination of spiraling planar surface toward interior wall 92. Ball output opening 85 of ball output 83 is positioned in interior wall 92 to receive balls from topmost flight 112. As balls such as ball B6 are elevated by the turning of topmost flight 112, they are held by a tab 116 in a position adjacent to ball output opening 83.

As best seen in FIG. 8, the clockwise rotation of topmost flight 112 urges ball B6 against tab 116. As flight 112 rotates, ball B6 is elevated until it is Juxtaposed with ball output opening 85. The inclination of spiral planar surface 94 urges ball B6 toward ball output opening 85, so that when ball B6 is sufficiently elevated, it rolls through ball output opening 114 and onto ramp 22. A conventional proximity switch (not shown) may be placed along ramp 22 near ball output 83 or, alternatively, along tube 26. The switch can detect when balls B are no longer exiting ball output 83. The absence of exiting balls for a predetermined time period is typically associated with a system failure or the exhaustion of the supply of balls B. Accordingly, the system operation can be shut down and a visual or audio alarm triggered.

Figure 10:
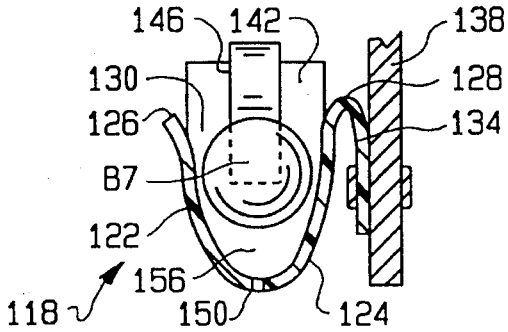
FIG. 10 is a sectional view of the discharge ramp shown in FIG. 9 taken along the lines 10—10.

Ramp 22, which is best seen in FIGS. 1, 8, 9 and 10, conveys clean balls from ball output 83 to discharge point 24. Except as otherwise noted, ramp 22 and its components are preferably of polycarbonate to avoid cracking which may be experienced with acrylic and other materials. Particularly, ramp 22 includes a plurality of (preferably five) elongated members 118. As best seen in FIG. 10, each elongated member 118 has two sidewalls 122 and 124 connected along longitudinal edges to form an upwardly opening cross section. Sidewalls 122 and 124 may also form a single unitary piece. The distal edges 126 and 128 of each sidewall are separated by a distance greater than the diameter of the balls to provide a track 130 therebetween for the gravity-propelled passage of balls such as ball B7.

As best seen in FIG. 10, the cross section of elongated member 118 has the general "V" shape although other shapes, such as "C" are possible. Preferably, one of sidewalls 122 and 124 has a mounting flange 134 along its longitudinal extent. Mounting flange 134 may be bolted or otherwise suitably fastened to a vertical chassis such as chassis 138.

While ramp 22 may be configured as a single, elongated ramp it is preferably comprised of a plurality of overlapping zig-zag flights such as formed by elongated members 118. Alternatively, for example, ramp 22 may be shaped as a continuous spiral.

As shown in FIG. 9, each of ramp members 118 has an upwardly extending ball input 139 for receiving balls and a downwardly extending ball output 140 for depositing balls. Ramp members 118 are arranged in a vertical zig zag pattern. The ball input 139 of the uppermost ramp member 118 is positioned to receive balls expelled from the ball output 83 of wash unit 14. The lowermost ramp member 118 is positioned to output balls B at discharge point 24. The intermediary ramp members 118, are arranged so that their respective ball inputs 139 are positioned to receive balls from the ball outputs 140 of the next highest one of ramp members 118. In addition to the useful rinsing (described below) action achieved by this zig-zag pattern, it has been found that this arrangement of ramps provides a visually appealing operation.

As best seen in FIGS. 9 and 10, ball input 138 of each ramp member 118 (other than the topmost ramp member) includes a backboard 142 mounted flush to the upper lateral edges of sidewalls 122 and 124 and having an upwardly extending planar face 144 which is transverse to track 130. A thin, elongated leaf spring or deflector 146 made of TEFLON™ is attached at one of its longitudinal ends to the top edge of face 144. The distal end 148 of leaf spring 146 curves away from face 144 to form an arcuate springboard against which falling balls such as ball B7 may impinge. When impinged by a falling ball such as ball B7, spring leaf 146 imparts a force on falling ball B7 urging it down track 130 of that one of ramp members 118 to which spring leaf 146 is attached.

It will be observed that as balls B roll down tracks 130 and, in particular, when balls undergo the jarring acceleration and deceleration associated with falling from a higher to a lower one of ramp members 118, the fluid applied to the balls B in wash unit 14 tends to be shaken off. Rinse fluid such as soft water is applied from a brass rinse fluid nozzle 149 positioned along ramp 22 near the upper end of ramp 22 for discharging a steady stream of rinse fluid. A rinse fluid drain inlet or hole 151 is provided near the bottom of ramp 22 for taking up rinse fluid.

It will be observed that rinse fluid discharged onto the uppermost of ramp members 118 tends to run along the plurality of ramp members in much the same way as balls B. To maximize the rinsing effect of the rinse fluid, each of ramp members 118 includes a plurality of holes such as hole 150 (shown in FIGS. 1 and 10) along connected edge of sidewalls 122 and 124. Thus rinse fluid running down track 130 of a particular ramp member 118 flows though holes 150 and rains down on balls traversing track 130 of the next lowest one off ramp members 118. It will be seen that the zig-zag configuration of ramp members 118 enables rinse fluid to be sprayed or drizzled multiple times onto balls B, even if only one rinse fluid discharge outlet 149 is used.

Rinse fluid ultimately flows to the bottommost of ramp members 118, where it is collected by rinse fluid drain hole 151. A barrier wall 154 is erected immediately downstream of drain hole 151. Barrier wall 154 serves to dam rinse fluid to prevent it from reaching discharge point 24. The planar face of barrier wall 154 is transverse to connected longitudinal edges of sidewalls 122 and 124 and is shaped to span the distance between sidewalls 122 and 124 for a portion thereof.

As best seen in FIG. 10, it will be noted that the geometry of track 130 creates a lower region 156 into which balls cannot extend. Because rinse fluid tends to collect in lower region 156, balls are sprayed and misted with but not soaked in rinse fluid. By suspending balls above (and not in) collected rinse fluid, track 130 prevents balls B from becoming saturated with rinse fluid. This in turn facilitates drying of ball B.

Figure 11:
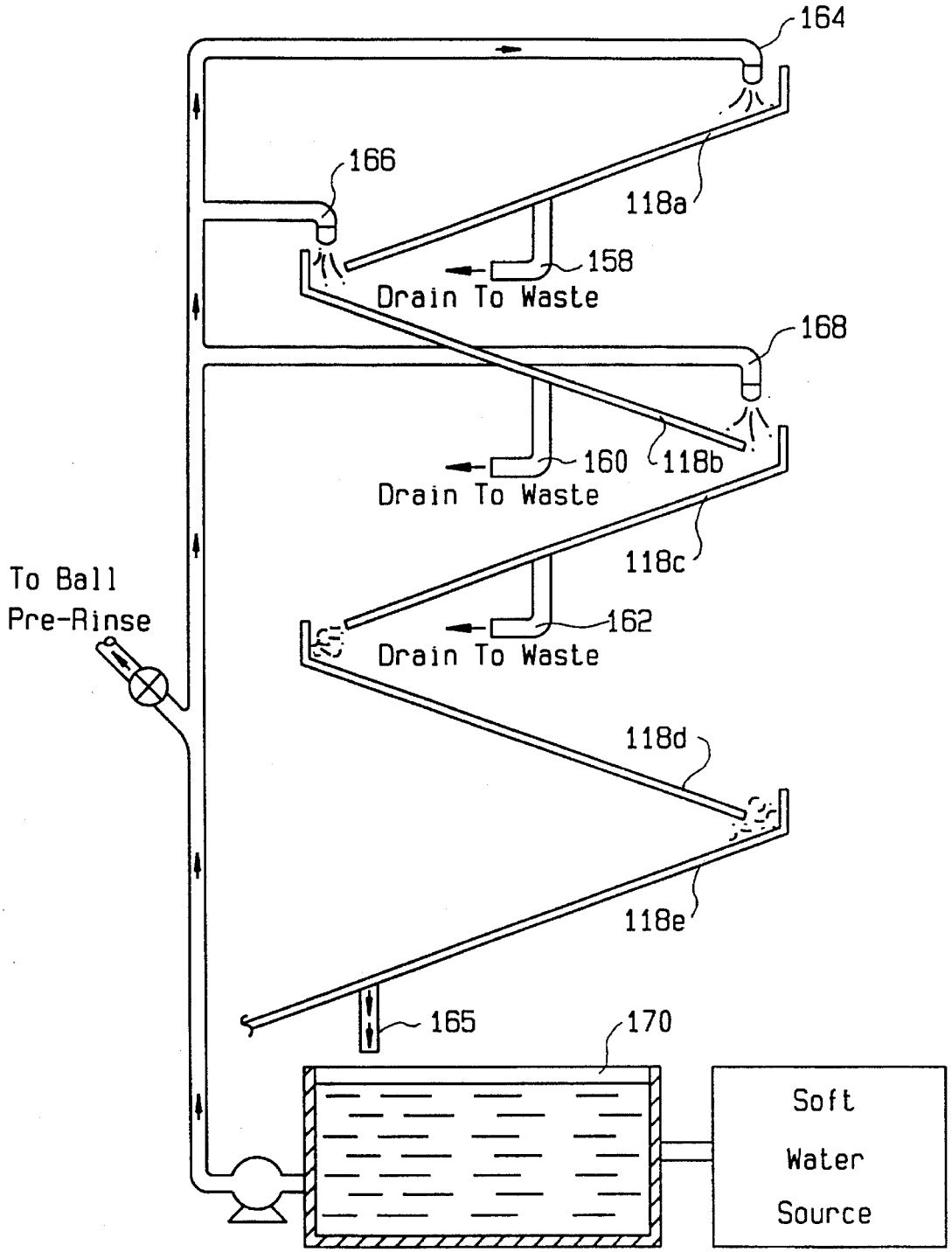
FIG. 11 is a schematic diagram of an alternative embodiment of the discharge ramp shown in FIG. 1.

An alternative embodiment of ramp 22 is illustrated in FIG. 11. Under this alternative embodiment, drain apertures 150 are replaced by drains 158, 160 and 162, which are substantially the same as drain hole 151 with barrier wall 154 described above. Water is sprayed on balls passing along the two topmost sections 118a and 118b by nozzles 164 and 166. This water is taken up by drains 158 and 160 and discharged as waste. Water is sprayed on the next lowest section 118*c* by nozzle 168. By the time balls B reach the third ramp 118*c*, they may be clean enough so that rinse water discharged from nozzle 168 could be taken up by drain 162 and fed to a reservoir tank 170 for reuse. Tank 170 feeds all of nozzles 164, 166 and 168, and may itself be fed by any suitable source of soft water. For purposes of conservation, tank 170 may be fed by surplus water such as generated by a dehumidifier. An additional drain 165 is provided for bottommost section 118*e*. Preferably, the bottommost one or two sections 118*d* and 118*e* are used for drying of balls and draining of rinse fluid.

First conventional pneumatic conveyor 26 powered by vacuum fan 172 receives balls deposited by ramp 22 at discharge point 24. Conveyor 26 carries balls through a tube 174 to collection bin 28, where the clean balls are stored. Collection bin 28 may include a removable sack 176 which is attached to a downwardly extending conventional spout (not shown). The spout may be selectively opened and closed for pouring clean balls accumulated in collection bin 28 into sack 176. For added visual effect and to facilitate drying, sack 176 may be of net or transparent material.

While the invention has been described with respect to certain preferred embodiments, variations, modifications, substitutions and alternatives will be apparent to those skilled in the art of ball washing apparatus, and accordingly the scope of the invention is defined by the appended claims.

I claim:

1. A method for washing balls in a cleaning fluid, comprising the steps of:

providing a housing comprising an elongated chamber suitable for receiving the cleaning fluid, having at a first longitudinal end of said elongated chamber a ball input, and having at a second longitudinal end of said elongated chamber a ball output, and having disposed therebetween first and second screw conveyers where the first and second screw conveyers are within said elongated chamber and rotate in the same direction for conveying said balls from the ball input toward the ball output, the screw conveyors being separately located from each other at the first and second longitudinal ends of said elongated chamber, respectively, to form in said elongated chamber a washing cell free of conveyer flights between said first and second longitudinal ends;

providing the cleaning fluid for washing the balls in the elongated chamber;

inputting the balls to be washed into the ball input;

conveying the balls by the first screw conveyor to the washing cell;

accumulating the balls conveyed by the first conveyer in the washing cell;

washing the balls in the cleaning fluid in the washing cell to form washed balls; and conveying the washed balls accumulated in the washing cell by the second conveyor to the ball output; and sequentially expelling the washed balls from the ball output.

2. The method of claim 1 further comprising the steps of providing a downwardly extending ramp having a top portion and being positioned to accept the washed balls expelled from the ball output;

applying a rinse fluid to the washed balls near the top of the ramp;

rolling the washed balls expelled from the ball output down the ramp;

the ramp having a plurality of flights, the flights at least partially overlapping one another and having a plurality of drain apertures for allowing the rinse fluid to drain from said washed balls wherein said rinse fluid flows from a higher to a lower one of the flights.

3. The method of claim 1 wherein the balls are inputted into the ball input sequentially at a measured rate.

4. The method of claim 1 wherein the balls are inputted into the ball input at time intervals which are periodically varied in accordance with a pattern.

5. The method of claim 1 wherein said step of providing a housing comprises providing a cylindrical housing having an axis that is substantially vertical.

6. The method of claim 5 wherein said step of providing a housing comprises providing a housing having an interior wall, a vertical shaft and a first screw conveyor having flights that are inclined downwardly as they extend away from the shaft toward the interior wall.

* * * * *